US012637189B2

(12) United States Patent
Savolainen et al.

(10) Patent No.: US 12,637,189 B2
(45) Date of Patent: May 26, 2026

(54) CONTROL METHOD FOR A WIND PROPULSION DEVICE ON A VESSEL

(71) Applicant: Norsepower Oy Ltd, Helsinki (FI)

(72) Inventors: Roope Savolainen, Helsinki (FI); Ville Paakkari, Helsinki (FI); Juha Manninen, Helsinki (FI); Jarkko Väinämö, Espoo (FI)

(73) Assignee: Norsepower Oy Ltd, Heslinki (FI)

( * ) Notice: Subject to any disclaimer, the term of this patent is extended or adjusted under 35 U.S.C. 154(b) by 665 days.

(21) Appl. No.: 18/004,972

(22) PCT Filed: Jun. 2, 2021

(86) PCT No.: PCT/FI2021/050407
§ 371 (c)(1),
(2) Date: Jan. 10, 2023

(87) PCT Pub. No.: WO2022/029362
PCT Pub. Date: Feb. 10, 2022

(65) Prior Publication Data

US 2023/0339585 A1 Oct. 26, 2023

(30) Foreign Application Priority Data

Aug. 4, 2020 (FI) ..... 20205780

(51) Int. Cl.
*B63H 9/02* (2006.01)
*B63B 79/10* (2020.01)
(Continued)

(52) U.S. Cl.
CPC ..... *B63H 9/02* (2013.01); *B63B 79/10* (2020.01); *B63B 79/15* (2020.01); *B63H 9/061* (2020.02)

(58) Field of Classification Search
CPC . B63H 9/02; B63H 9/061; B63H 9/00; B63H 9/04; B63H 9/06; B63B 79/15;
(Continued)

(56) References Cited

U.S. PATENT DOCUMENTS 6,308,649 B1 10/2001 Gedeon
2003/0226707 A1* 12/2003 Ho ..... F16H 59/68 180/307

(Continued)

FOREIGN PATENT DOCUMENTS

CN 103906680 A 7/2014
EP 0107285 A1 5/1984

(Continued)

OTHER PUBLICATIONS

English translation of EP2706227A2 (Year: 2014).*

(Continued)

*Primary Examiner* — Michael C Zarroli
(74) *Attorney, Agent, or Firm* — Ziegler IP Law Group, LLC.

(57) ABSTRACT

A method for controlling a wind propulsion device arranged on a vessel includes providing pressure information from a first pressure sensor arranged on a surface of the wind propulsion device, estimating pressure distribution on the surface of the wind propulsion device based on the pressure information from the first pressure sensor, providing angular position information of wind propulsion device, estimating apparent wind angle based on the angular position information of wind propulsion device and the estimated pressure distribution on the surface of the wind propulsion device, using the estimated apparent wind angle for determining initial approximation for control parameters, and using the
(Continued)

estimated pressure distribution as a feedback in closed-loop control method to optimise the control parameters of the wind propulsion device.

12 Claims, 6 Drawing Sheets

(51) Int. Cl.
*B63B 79/15* (2020.01)
*B63H 9/061* (2020.01)

(58) Field of Classification Search
CPC . B63B 2035/009; Y02T 70/5236; G01P 5/00; G05D 1/02
See application file for complete search history.

(56) References Cited

U.S. PATENT DOCUMENTS

| | | | |
|---|---|---|---|
| 2016/0121986 | A1 | 5/2016 | Riski et al. |
| 2016/0221656 | A1 | 8/2016 | Dogliotti et al. |
| 2019/0163187 | A1 | 5/2019 | Sornique et al. |

FOREIGN PATENT DOCUMENTS

| | | | | |
|---|---|---|---|---|
| EP | 2706227 | A2 * | 3/2014 | ..... F03D 1/04 |
| EP | 2999627 | A1 | 3/2016 | |
| EP | 3016854 | A1 | 5/2016 | |
| EP | 3202657 | B1 | 10/2018 | |
| EP | 3492927 | A1 | 6/2019 | |
| FR | 3086267 | A1 | 3/2020 | |
| JP | S59501706 | A | 10/1984 | |
| JP | 2013537864 | A | 10/2013 | |
| JP | 2014516874 | A | 7/2014 | |
| JP | 2015036292 | A | 2/2015 | |
| JP | 2015145241 | A | 8/2015 | |
| WO | 2012178006 | A2 | 12/2012 | |

OTHER PUBLICATIONS

English translation EP2706227 (Year: 2014).*
Finnish Patent and Registration Office, Search Report, U.S. Appl. No. 20/205,780, mailed Nov. 11, 2020, 1 page.
The International Preliminary Report on Patentability, European Patent Office, Application No. PCT/FI2021/050407, mailed Oct. 13, 2022, 18 pages.
The International Search Report and Written Opinion of the International Searching Authority, European Patent Office, Application No. PCT/FI2021/050407, mailed Sep. 30, 2021, 14 pages.
Japan Patent Office, Notification of ground of rejection, Application No. 2023503990, mailed Dec. 21, 2023, 3 pages, English Translation, 2 pages.
European Patent Office, Communication pursuant to Article 94(3) EPC, Application 21732090.2, mailed Nov. 20, 2023, 5 pages.

* cited by examiner

CONTROL METHOD FOR A WIND PROPULSION DEVICE ON A VESSEL

TECHNICAL FIELD

The present disclosure relates generally to wind propulsion devices; and more specifically, to a method for controlling wind propulsion devices arranged on a vessel.

BACKGROUND

In recent times, significant developments have been made in maritime industry to utilize wind energy for propulsion of vessels such as tanker vessels, cargo vessels, passenger vessels, boats, and so forth. Wind propulsion devices such as Magnus-rotors or aerofoil sails, are increasingly being used to assist conventional propulsion systems such as submerged propellers. Specifically, such wind propulsion devices are vertically installed onto the vessels, and generate a lift (or thrust) perpendicular to a direction of wind flow, and such lift acts as a propulsion force for the vessels.

Generally, precise control of such wind propulsion devices is required to ensure optimum efficiency thereof. Notably, control parameters such as rotation speed and rotation direction of a Magnus rotor, or angle of attack of an aerofoil sail, are regularly monitored and regulated based on wind conditions surrounding the vessel. Such regulation of control parameters is generally performed based on information from multiple measurement devices, such as weather masts, anemometers or dedicated wind sensors, for measurement of wind direction (or wind angle) and wind speed, arranged on the vessel. However, such measurement devices generally measure wind conditions at a point where they are installed and do not account for a change in wind profile and pressure distribution due to various structures on the vessel. Furthermore, measurement devices are typically not installed proximate to the wind propulsion device. Therefore, wind conditions recorded by the measurement device may significantly vary in comparison to the wind conditions observed at wind propulsion device. Alternatively, if a measurement device is installed proximate to the wind propulsion device, due to its operation, the wind propulsion device may cause an error in measurement of the wind condition by the measurement device. Therefore, the control parameters for the operation of the wind propulsion device determined using such measurement techniques typically result in non-optimal operation of the wind propulsion device.

Furthermore, strain-based measurements may be employed for measurement of the lift or force generated by the wind propulsion device. Specifically, by measurement of flexion in structure of the wind propulsion device, the force acting on the tower due to the wind may be calculated. However, turbulence caused by hull of the vessel, or varying environmental conditions significantly affect the force transmitted to the wind propulsion device and thus flexion caused in the structure of the wind propulsion device may consequently vary. Moreover, typical strain-based measurement techniques are designed for measurement of larger magnitudes of strain than those encountered in wind propulsion devices. Therefore, such strain-based measurements may not be sufficiently precise.

In light of the forgoing discussion, there exists a need to overcome the aforementioned drawbacks associated with optimising control parameters for a wind propulsion device.

SUMMARY

The present disclosure seeks to provide a method for controlling a wind propulsion device. The present disclosure seeks to provide a solution to the existing problem of inaccurate and unreliable measurement techniques resulting in inefficient operation of wind propulsion devices. An aim of the present disclosure is thus to provide a solution that overcomes at least partially the problems encountered in prior art, and provides an efficient method of optimising control parameters related to wind propulsion devices.

In one aspect, an embodiment of the present disclosure provides a method for controlling a wind propulsion device arranged on a vessel, comprising

- providing pressure information from at least a first pressure sensor arranged on a surface of the wind propulsion device at a first height H1 with respect to a deck of the vessel;
- estimating pressure distribution on the surface of the wind propulsion device based on the pressure information from the at least first pressure sensor and
- using the estimated pressure distribution as a feedback in closed-loop control method to optimise a control parameters of the wind propulsion device.

In another aspect, an embodiment of the present disclosure provides a method for controlling a system of wind propulsion devices arranged on a vessel, comprising

- optimising the control parameters of each wind propulsion device according to the method for controlling a wind propulsion device arranged on a vessel; and
- optimising a total efficiency of the wind propulsion devices, by taking into account the interaction between each wind propulsion device by measuring the individual differences in performance;

wherein the wind propulsion devices are arranged at different positions on the vessel, with respect to a length of the vessel.

In yet another aspect, an embodiment of the present disclosure provides a vessel comprising at least two wind propulsion devices, each wind propulsion device comprising at least a first pressure sensor, wherein the first pressure sensor is arranged on a surface of the wind propulsion device at a first height H1 with respect to a deck of the vessel, and the vessel is further equipped with means for carrying out the method for controlling a wind propulsion device arranged on a vessel.

In yet another aspect, an embodiment of the present disclosure provides a software product recorded on non-transient machine-readable data storage media, wherein the software product is executable upon computing hardware for implementing a method for controlling a wind propulsion device arranged on a vessel.

Embodiments of the present disclosure substantially eliminate or at least partially address the aforementioned problems in the prior art, and enables efficient operation of wind propulsion devices by optimisation of control parameters for operation thereof.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein.

Figure 1:
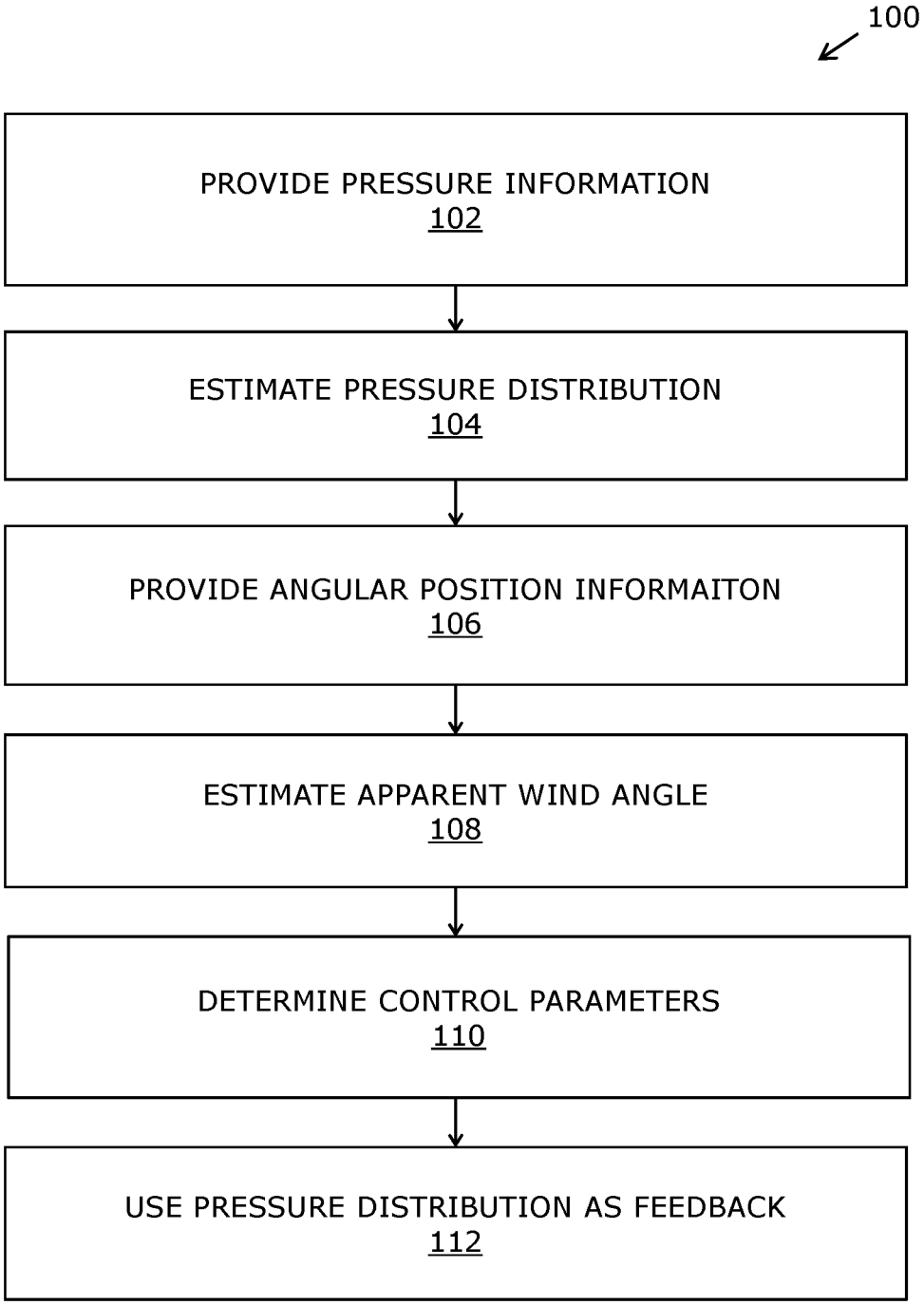
FIG. 1 is an illustration of steps of a method for controlling a wind propulsion device arranged on a vessel, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also included.

In one aspect, an embodiment of the present disclosure provides a method for controlling a wind propulsion device arranged on a vessel, comprising providing pressure information from at least a first pressure sensor arranged on a surface of the wind propulsion device at a first height H1 with respect to a deck of the vessel;

estimating pressure distribution on the surface of the wind propulsion device based on the pressure information from the at least first pressure sensor and using the estimated pressure distribution as a feedback in closed-loop control method to optimise a control parameters of the wind propulsion device.

The method for controlling a wind propulsion device as described herein enables an improved control and optimisation of operation of a wind propulsion device. The present disclosure provides an improved method using pressure measurement that enables a real-time estimation of pressure distribution on the overall surface of the wind propulsion device and also allows estimation of wind conditions, such as wind angle and wind speed around the wind propulsion device. Beneficially, such method of pressure measurement eliminates a need of multiple measurement devices for measuring wind conditions. The method described herein employs direct pressure measurement that is used to determine pressure distribution and force acting on the wind propulsion device. Furthermore, the method as described in the present disclosure is applicable to multiple types of wind propulsion devices without the need of significant modification. Notably, the method of the present disclosure significantly increases efficiency of the wind propulsion device arranged on a vessel, thereby increasing a contribution of the wind propulsion device towards the overall propulsion of the vessel.

The present disclosure provides a method for controlling a wind propulsion device arranged on a vessel. Herein, the term "vessel" refers to a ship or a watercraft used for purposes such as transportation of cargo and passengers, sea exploration and the like. Typically, vessels are propelled using engines or turbines. The vessel is further arranged with a wind propulsion device to assist the engine in propulsion of the vessel. Herein, the term "wind propulsion device" refers to a device that is used to reduce fuel consumption of a vessel by assisting the primary propulsion means, such as the engine or the turbine, in movement of the vessel. Such wind propulsion device may also be used as the sole propulsion means of the vessel. Specifically, the wind propulsion device captures kinetic energy of wind around the vessel to assist in propulsion thereof. Examples of wind propulsion devices include, but are not limited to, Magnus-rotors (such as Flettner rotors) and aerofoil sails (such as wing sails). An aerofoil sail can be for example a wing sail, a rigid sail or a suction wing sail (may also be called a turbo sail). Notably, control parameters of the wind propulsion devices are adjusted according to external factors such as one or more of atmospheric pressure, speed of the wind surrounding the vessel, speed of the vessel, direction of flow of wind, direction of movement of the vessel and so forth, to ensure an optimised propulsion output from the wind propulsion device. The present disclosure provides a method of controlling the wind propulsion device to optimise such control parameters.

The method comprises providing pressure information from at least a first pressure sensor arranged on a surface of the wind propulsion device at a first height H1 with respect to a deck of the vessel. Specifically, the first pressure sensor determines air pressure on the surface of the wind propulsion device. It will be appreciated that when the vessel is in motion, flow of wind around the vessel exerts force onto the wind propulsion device, which is harnessed to assist movement of the vessel. The pressure information, received from the first pressure sensor arranged on the surface of the wind propulsion device, refers to information relating to such forces exerted by the wind on the wind propulsion device.

Examples of pressure sensors include, but are not limited to, differential pressure sensor, pressure anemometer and piezoelectric pressure sensors. Furthermore, the first height H1 at which the first pressure sensor is arranged is selected based on factors such as height of the wind propulsion device, size of the vessel, atmospheric and weather conditions in typical operating environment of the vessel. Notably, the first pressure sensor provides pressure information of the cross-section at height H1 of the wind propulsion device. In an example, the wind propulsion device is a Magnus-rotor, wherein a singular pressure sensor is arranged on the surface thereof. In such example, as the Magnus-rotor rotates, the singular pressure sensor rotating with the Magnus-rotor measures pressure information relating to different areas of the cross section at which the pressure sensor is arranged. In another example, the wind propulsion device is an aerofoil sail, wherein preferably multiple pressure sensors (such as two, three or four) are arranged on the surface of the aerofoil sail. In such example, each of the multiple pressure sensors provide pressure information relating to the area on the surface of the aerofoil sail that it is arranged on. The number of pressure sensors used may thus be 2, 3, 4, 5, 6, 7, 8, 9, 10, 11, 12, 13, 14, 15, 20, 25, 30, 35 or even 40.

The method comprises estimating pressure distribution on the surface of the wind propulsion device based on the pressure information from the at least first pressure sensor. Notably, pressure exerted by the wind on the surface of a wind propulsion device varies based on a direction of flow and speed of the wind. The at least first pressure sensor arranged on the surface of wind propulsion device provides information relating to such variation of pressure on different parts of the surface of the wind propulsion device. Consequently, based on the pressure information provided by the at least first pressure sensor, the pressure distribution on the surface of the wind propulsion device is estimated. Specifically, the pressure distribution on the surface of the wind propulsion device provides an estimation of pressure difference between the fore and aft sides of the wind propulsion device. When the wind propulsion device is the Magnus-rotor, this is achievable with one pressure sensor, as the Magnus-rotor rotates. When the wind propulsion device is the aerofoil sail, it is preferably to have at least two pressure sensors arranged thereon provide pressure information relating to different areas on the surface of the aerofoil sail. Using such pressure information relating to different areas on the surface of the wind propulsion device, the pressure distribution on the surface of the wind propulsion device is estimated.

Optionally the method for controlling the wind propulsion device comprises providing angular position information of the wind propulsion device. Notably, angular position information of the wind propulsion device refers to the parameters relating to the positioning and operating information of the wind propulsion device that impact the propulsion force provided thereby. Specifically, angular position information of the wind propulsion device significantly affects direction of movement and speed of the vessel. In an embodiment, when the wind propulsion device is the Magnus-rotor, the angular position information may include, but is not limited to, dimensional information (such as height, diameter) of the Magnus-rotor, rotational speed of the Magnus-rotor and direction of rotation of the Magnus-rotor. In an embodiment, when the wind propulsion device is the aerofoil sail, the angular position information may include, but is not limited to, type of aerofoil sail, dimensional information (such as chord length, height, curvatures of leading edge and trailing edge) of the aerofoil sail and angle of attack of the aerofoil sail.

The method may additionally comprise estimating apparent wind angle based on the angular position information of wind propulsion device and the estimated pressure distribution on the surface of the wind propulsion device. Specifically, the apparent wind angle refers to the direction of flow of the wind with respect to the wind propulsion device. Notably, the apparent wind angle may be measured with respect to one of amidships of the vessel, such as the amidships along central fore and aft line of the vessel. It will be appreciated that the estimated pressure information provides information relating to the areas on the surface of the wind propulsion device that experience a higher degree of pressure in comparison to other areas on the surface of the wind propulsion device. Consequently, it may be concluded that the areas experiencing the higher degree of pressure are impacted by the flow of the wind directly, and thus the direction of flow of wind may be estimated in the direction of such areas. Therefore, based on angular positioning information, the positioning of such areas on the wind propulsion device with respect to one of the amidships is determined and consequently, the apparent wind angle is estimated.

A pressure measured by a pressure sensor reaches its maximum when the pressure sensor, which is arranged on the surface of a wind propulsion device, coincides with a stagnation point. The stagnation point is a point, in where, all kinetic energy of the wind is converted to a pressure (potential energy). In general, for a known sail geometry and operational status of the sail, a location of stagnation point(s), is related with the angle of attack. Therefore the angle of attack can be deduced if stagnation point can be found. i.e. the angle of attack is related to point at which the pressure maximum was measured.

The method might comprise additionally using the estimated apparent wind angle for determining initial approximation for control parameters. Notably, the control parameters vary based on a type of wind propulsion device arranged on the vessel. In an example, the control parameters for a Magnus-rotor may be rotational speed of the Magnus-rotor and/or rotational direction of the Magnus-rotor. In another example, the control parameters for an aerofoil sail may be angle of attack of the aerofoil sail. It will be appreciated that the estimated apparent wind angle merely provides an initial approximation for control parameters. Such control parameters are implemented on the wind propulsion device and are adjusted regularly for optimisation and increased efficiency.

Hereinafter, exemplary embodiments wherein the wind propulsion device is the Magnus-rotor are discussed. Whenever appropriate, the same details and embodiments apply to other types of wind propulsion devices.

Throughout the present disclosure, the term "Magnus-rotor" refers to a longitudinal structure, such as a tower, that is rotated along longitudinal axis thereof and generates a force perpendicular to the longitudinal axis and direction of flow of wind. Such force is generated as a result of Magnus effect, and provides propulsion to the vessel using flow of wind around the vessel. Furthermore, the Magnus-rotor may comprise disc end plates for stabilisation thereof. Generally, Magnus-rotors are cylindrical, such as a Flettner rotor, however, the cross-section of the Magnus-rotor may be circular, square, rectangle or any polygon.

Optionally, the angular position information is provided by an angular position measurement device. Herein, the angular position information comprises at least one of rotational speed of the Magnus-rotor, angle of rotation of the Magnus-rotor and direction of rotation of the Magnus-rotor. The angular position information may optionally include dimensional information (such as height, diameter) of the Magnus-rotor. Furthermore, the angular position measurement device may be a rotary encoder, a tachometer, a gyroscope or the like. Specifically, the rotary encoder is a position sensor operable to determine angular position of the Magnus-rotor. It will be appreciated that the angular position information is preferably measured at a high frequency and with high accuracy to obtain accurate results. Therefore, specialised devices such as the rotary encoder are employed to measure the angular position information. Furthermore, the control parameters comprise optimal rotation speed of the Magnus-rotor. Notably, based on the apparent wind angle, the optimal rotation speed at which the propulsion force provided to the vessel is maximum is determined.

Optionally, the method further comprises calculating wind speed u. For calculating the wind speed u, firstly air density ρ is calculated. Equation (1) gives the mathematical formula for air density as, $$\rho = \frac{p}{R_{(specific)}T} \tag{1}$$

where $R_{(specific)}$ is specific gas constant for dry air, p is the atmospheric pressure around the vessel and T is the temperature around the vessel. Herein, the value of specific gas constant for dry air $R_{(specific)}$ is typically 287.058 $J \cdot kg^{-1} \cdot K^{-1}$ based on a mean molar mass for dry air of 28.9645 g/mol. However, the value of $R_{(specific)}$ may vary slightly depending on the molecular composition of air at a particular location.

Furthermore, the atmospheric pressure p is approximated either by a pressure at a back side of the rotor or using a dedicated sensor. Herein, the back side of the rotor refers to a side of the rotor that does not receive any direct influx of wind thereon. Therefore, the pressure at the back side of the rotor is not affected by the flow of the wind and thus, is substantially similar to the atmospheric pressure. Alternatively, a dedicated sensor such as a barometric pressure sensor, is used for measurement of atmospheric pressure. Moreover, the temperature T is typically determined using a temperature sensor such as a thermometer or a thermistor.

Subsequently, a maximum dynamic pressure q on the surface of the Magnus-rotor is calculated by subtracting the atmospheric pressure p from a maximum pressure on the surface of the Magnus-rotor. The maximum pressure on the surface of the Magnus-rotor is typically determined using the pressure information from the at least first pressure sensor arranged on a surface of the Magnus-rotor. Subsequently, the calculated air density ρ and the maximum dynamic pressure q are inputted in equation (2) to calculate the wind speed u, $$u = \sqrt{\frac{2q}{\rho}}; \tag{2}$$

Thereafter, the method further comprises using the estimated apparent wind angle to determine an optimal rotation direction of the Magnus-rotor. Notably, the rotation direction of the Magnus-rotor may be either clockwise or counter-clockwise. In an example, the apparent wind angle indicates a wind flowing from the starboard side of the vessel to the port side of the vessel. In such example, the optimal rotation direction of the Magnus-rotor may be counter-clockwise to generate a Magnus force towards the bow of the vessel.

Furthermore, the method comprises using the calculated wind speed, in addition to the estimated apparent wind angle, to determine the initial approximation for control parameters. As mentioned previously, the control parameters for a Magnus-rotor comprise optimal rotation speed of the Magnus-rotor. Notably, the rotation speed of the Magnus-rotor is adjusted to optimise rotation speed to wind speed ratio, to consequently optimise the propulsion force generated by Magnus effect. It will be appreciated that the propulsion force increases with an increase of rotation speed of the Magnus-rotor. However, fuel is consumed to generate rotation in the Magnus-rotor and such fuel consumption increases with the increase in rotation speed. Therefore, the rotation speed of the Magnus-rotor is optimised in a manner that the benefit obtained from propulsion force generated by the rotation of the Magnus-rotor is greater than fuel consumed for the rotation thereof.

Optionally, the method further comprises providing pressure information from at least a second pressure sensor, wherein

- the second pressure sensor is arranged at a second height H2 with respect to the deck of the vessel;
- a difference between the first height H1 and the second height H2 is at least 20% of a total height H of the Magnus-rotor; and
- estimating pressure distribution is carried out by interpolating and extrapolating the pressure distribution on the surface of the Magnus-rotor based on the pressure information from the at least first pressure sensor and second pressure sensor.

Optionally in this regard, the second pressure sensor is arranged on the vessel to estimate pressure distribution on the surface of the Magnus-rotor with greater accuracy in comparison with using pressure information from only the first pressure sensor. It will be appreciated that the pressure distribution at different heights of the Magnus-rotor is different due to a non-uniform flow of the wind. Therefore, a second pressure sensor, arranged at a height H2 and at a height difference of at least 20% of the total height H with the height H1 of the first pressure sensor, provides pressure information that is different from the pressure information provided by the first pressure sensor. Consequently, interpolation and extrapolation of the pressure information can be performed with information from two different pressure sensors at different heights. Specifically, the first pressure sensor and the second pressure sensor arranged at different heights H1 and H2 respectively provide insight into the manner the pressure distribution varies as the height varies. Such manner of variation of pressure distribution may then be extrapolated and interpolated to estimate pressure distribution on the surface of Magnus-rotor. It will be appreciated that in an implementation when the first pressure sensor and the second pressure sensor are installed at two terminating ends of the Magnus-rotor, only interpolation may be required to estimate the pressure distribution on the surface of the Magnus-rotor. In a simplified exemplary illustration, the variation in pressure is estimated as a function of height, such as a linear function or a power function. Furthermore, based on pressure information provided by multiple pressure sensors, sophisticated fluid dynamics models may be computed to estimate the pressure distribution on the surface of Magnus-rotor.

Optionally, the method further comprises arranging at least a third pressure sensor on the surface of the Magnus-rotor, wherein the third pressure sensor is arranged at a third height H3 with respect to the deck of the vessel and a difference between the first height H1, the second height H2 and the third height H3 is each at least 10% of the total height H of the Magnus-rotor.

Optionally, the method further comprises arranging a number of further pressure sensors on the surface of the Magnus-rotor, wherein each further pressure sensor is arranged at a given height with respect to the deck of the vessel and the difference between each height of the pressure sensors is at least 5% of the total height H of the Magnus-rotor, and wherein the number is at least four.

Optionally in this regard, as mentioned previously, the pressure distribution varies at different heights of the Magnus-rotor due to a non-uniform flow of the wind. Therefore, multiple pressure sensors are installed at different heights to estimate pressure distribution on the surface of the Magnus-rotor with greater accuracy. Furthermore, the difference between each height of the pressure sensors is ensured to enable recording of pressure information at substantially different heights and obtain a better estimation of the pressure distribution on the complete height of the Magnus-rotor. Beneficially, accuracy of the pressure distribution estimated by the interpolation and extrapolation of pressure information increases as the number of pressure sensors providing the pressure information increases.

Optionally, the pressure sensors are arranged along a line that is substantially parallel to a rotation axis of the Magnus-rotor. As mentioned previously, the Magnus-rotor is a longitudinal structure with the longitudinal axis as the axis of rotation. Therefore, the pressure sensors are arranged in a straight line on the surface of the Magnus-rotor substantially parallel to the axis of rotation.

Alternatively, optionally, the pressure sensors are arranged along a spiral line. Specifically, the imaginary spiral line is traced on the surface of the Magnus-rotor.

Optionally, the method further comprises measuring Magnus-rotor forces by combining strain measurements and measurements of displacement of a lower bearing point. It will be appreciated that a Magnus force $F_m$ generated by the Magnus-rotor is counter-balanced by forces from a upper bearing arranged in the Magnus-rotor support structure and the lower bearing point. While counter-balancing the Magnus force, the Magnus-rotor may undergo flexural bending and a displacement of the bearing point. Notably, the upper bearing constrains the flexural bending of the Magnus-rotor by providing a counter force $F_{mb}$. Herein, the Magnus-rotor undergoes the flexural bending which causes a strain that can be measured $\Delta L/L_o$, wherein $L_o$ is the specified reference length which length change $\Delta L$ is to be measured after undergoing flexural bending. The measurement system needs to be calibrated to know correlation between upper bearing load and strain. This correlation value is called a sensitivity. Sensitivity $S_{se}$ is given by equation (3), $$S_{en} = \frac{F_{mb}}{\frac{\Delta L}{L_o}} \tag{3}$$

where $F_{mb}$ is the measured or known upper bearing force and $\Delta L/L_o$ is the corresponding strain value. Afterwards when sensitivity is known the upper bearing force is obtained by multiplying the sensitivity by measured strain value. The $F_{mb}$ behaves linearly regarding the strain value. Furthermore, the displacement of the lower bearing point is constrained by the force $F_{lb}$, calculated using equation (4)

$$F_{lb}=k_{lb}x \tag{4}$$

where x is the displacement of the lower bearing point and $k_{lb}$ is a calibrated measurement of spring factor for the lower bearing point. $K_{lb}$ is a function of the displacement x. Notably, the total Magnus force shall be a sum of $F_{mb}$ and $F_{lb}$. The method further comprises using the measured Magnus-rotor forces as a feedback in the optimisation of the Magnus-rotor operation. Notably, strain-based measurement of the Magnus-rotor forces can, beneficially, be employed for cross-verification of results from the pressure-based measurement. Furthermore, the magnitude of flexural bending and displacement observed in Magnus-rotors is significantly low. Therefore, sophisticated measurement arrangements such as an arrangement comprising electrical connection of two strain gauge resistive bridges installed at opposite ends of the Magnus-rotor, thereby creating an amplification of the strain signal, are employed. Beneficially, diametrically opposed measurements from such sensors negate effects of thermal expansion in the Magnus-rotor. Hereinafter, there are discussed exemplary embodiments wherein the wind propulsion device is the aerofoil sail. Whenever appropriate, the same details and embodiments apply to other types of wind propulsion devices.

Throughout the present disclosure, the term "aerofoil sail" refers to a structure arranged on a vessel, wherein the cross-section of the structure is in shape of an aerofoil that produces an aerodynamic force when moving through air. Notably, the aerofoil sail when moving through the air or wind, penetrates the air and generates the aerodynamic force. Herein, due to the aerofoil structure of the sail and the movement of wind along the aerofoil, a lower pressure on a convex side of the aerofoil sail is observed in comparison to the pressure on a concave side of the aerofoil sail. Alternatively, in case of symmetrical aerofoil profiles, the pressure difference is generated by the angle of attack. Consequently, due to such pressure difference, a force is generated from the high-pressure areas to low-pressure areas. Such force generated due to the pressure difference is used at least in part to propel the vessel. Herein, a foremost edge of the aerofoil sail that directly penetrates the flow of the wind is referred to as a leading edge, and an aft or back edge of the sail opposite to the leading edge, is referred to as a trailing edge. Furthermore, a straight line between the leading edge and the trailing edge is referred to as a chord line of the aerofoil sail. Similarly, a line between the leading edge and the trailing edge that traces the surface of the aerofoil sail is referred to as a chord of the aerofoil sail. It will be appreciated that for a given aerofoil sail, there can exist different chords and chord lines at different heights. Notably, the chord line is employed to determine an angle of attack of the aerofoil sail. Specifically, the angle of attack is used to control the aerodynamic force generated by the aerofoil sail, and is defined as the angle between the chord line and vector representing the direction of flow of wind. Examples of the aerofoil sail include, but are not limited to, soft wing sails, rigid wing sails and suction wing sails (also called turbo-sails).

Optionally, the pressure information is provided additionally from a second pressure sensor arranged on the surface of the aerofoil sail at the height H1 with respect to the deck of the vessel. Notably, the second pressure sensor is arranged at the same height H1 as the first pressure sensor to measure pressure information at the same height of the aerofoil sail, however at a different area of the cross-section thereof. Specifically, the first and second pressure sensors are arranged at different chordwise locations, in respect to each other's, on the aerofoil sail at a distance D1 of at least 20% of the chord length from one another. Herein, the chord length refers to a length of the chord line joining the leading edge and the trailing edge. Notably, the first and the second pressure sensors are arranged at substantially different areas of the aerofoil to obtain pressure information at different areas of the cross-section of the aerofoil to estimate the pressure distribution on the surface of the aerofoil sail with a higher accuracy. Furthermore, the first and second pressure sensors are arranged on opposing sides of the aerofoil sail. Herein, opposing sides of the aerofoil sail refer to the different surfaces connecting the leading and trailing edge of the aerofoil sail. As mentioned previously, different pressures are observed on opposing sides of the aerofoil sail. It will be appreciated that such difference in pressure is indicative of the propulsion force provided by the aerofoil sail. Therefore, the first and second pressure sensors are arranged on opposing sides of the aerofoil sail to estimate such pressure difference. Alternatively, the first pressure sensor is arranged on a one side of the aerofoil sail and the second pressure sensor is arranged on a leading edge of the aerofoil sail. As mentioned previously, the leading edge of the aerofoil is the foremost edge thereof that directly penetrates the flow of wind. The pressure observed at the leading edge may provide further insights relating to an effect of angle of attack of the aerofoil sail on the propulsion force provided thereby and speed of the vessel. Further alternatively the first and second pressure sensors are arranged on the same side of the aerofoil sail.

Alternatively the first and second pressure sensors are arranged along a chord of the aerofoil sail at a distance D1 of at least 20% of the chord length from one another.

As described previously for the Magnus-rotor, similarly for the aerofoil sail the method further comprises calculating wind speed u. Firstly, air density ρ is calculated. Equation (5) gives the mathematical formula for air density:

$$\rho = \frac{p}{R_{(specific)}T} \tag{5}$$

where $R_{(specific)}$ is specific gas constant for dry air, p is the atmospheric pressure around the vessel and T is the temperature around the vessel. Notably, the atmospheric pressure p is using a dedicated sensor. Alternatively, in a preferable embodiment, a dedicated sensor such as a barometric pressure sensor, is used for measurement of atmospheric pressure. Subsequently, a maximum dynamic pressure q on the surface of the aerofoil is calculated by subtracting the atmospheric pressure p from a maximum pressure on the surface of the aerofoil sail. The maximum pressure on the surface of the aerofoil sail is determined using the pressure information from the at least first pressure sensor arranged on a surface of the aerofoil sail. Subsequently, the calculated air density ρ and the maximum dynamic pressure q are inputted in equation (6) to calculate the wind speed u, $$u = \sqrt{\frac{2q}{\rho}}; \tag{6}$$

Subsequently, the method comprises using the estimated apparent wind angle to determine an optimal angle of attack of the aerofoil sail. Herein, for the aerofoil sail, the angle of attack significantly and primarily affects the aerodynamic force (namely, lift) generated by the aerofoil sail. Therefore, the angle of attack is optimised for the estimated apparent wind angle. The method further comprises using the calculated wind speed, in addition to the estimated apparent wind angle, to determine the initial approximation for control parameters. Herein, the control parameters primarily include the angle of attack of the aerofoil sail. The wind speed, in addition to the wind angle, significantly affects the aerodynamic force generated by the aerofoil sail and thus, the angle of attack is further optimised based on the wind speed. The method thus comprises repeatedly re-calculating and re-estimating the various parameters, to keep optimising the control parameters of the wind propulsion device.

Optionally, the method further comprises providing pressure information from at least a third pressure sensor, wherein the third pressure sensor is arranged in a third chordwise location. Alternatively the third pressure sensor is arranged along the same chord as the first and second pressure sensors. Notably, the aerofoil sail has a plurality of chords thereof at different heights of the aerofoil sail. For example, the line joining the leading edge and the trailing edge at a height H1 is a different chord in comparison with a line joining the leading edge and the trailing edge at height H2 and so forth. Herein, the third pressure sensor is arranged along the same chord as the first and second pressure sensors. Optionally, the first, second and third pressure sensors are arranged along a chord of the aerofoil sail each at a distance of at least 10% from one another. Notably, the pressure distribution varies at different areas along the chord of the aerofoil sail due to a non-uniform flow of the wind. Therefore, the three pressure sensors are installed at different distances on the chord to estimate pressure distribution on the surface of the aerofoil sail with greater accuracy. Optionally, the third sensor is arranged on an opposing side of the aerofoil sail, in comparison with one of or both the first pressure sensor and second pressure sensor.

Optionally, the method further comprises arranging a number of further pressure sensors on the surface of the aerofoil sail, along at least two different chords of the aerofoil sail, wherein the pressure sensors are divided between the two sides of the aerofoil sail and its leading edge. Herein, a number of further pressure sensors are arranged over the surface of the aerofoil sail at different chords, on both sides of the aerofoil sail and on the leading edge of the aerofoil sail to accurately estimate the pressure distribution over the entire surface of the aerofoil sail. Notably, computation fluid mechanics models may be modelled for the aerofoil sail, wherein such models may interpolate and extrapolate pressure information from the pressure sensors to simulate a working model of the aerofoil sail where changes to control parameters such as the angle of attack and their effects on the propulsion force are estimated in real time. Therefore, pressure information from a plurality of pressure sensors positioned strategically over the surface of the aerofoil sail enables a significantly accurate interpolation and extrapolation, thereby resulting in a simulation of the aerofoil sail that closely mimics real-life behaviour of the aerofoil sail. In an example, the aerofoil sail may have six pressure sensors arranged thereon, wherein the first, second and third pressure sensors are arranged along the same chord, the first and second pressure sensors are arranged on opposing sides of the aerofoil sail, the third pressure sensor is arranged on the trailing edge of the aerofoil sail. A fourth pressure sensor of the six pressure sensors is arranged at the trailing edge of the aerofoil sail, and a fifth and sixth pressure sensors are arranged on opposite sides of the aerofoil sail along different chords. The number of pressure sensors used may thus be 2, 3, 4, 5, 6, 7, 8, 9, 10, 11, 12, 13, 14, 15, 20, 25, 30, 35 or even 40.

Optionally, the method further comprises measuring aerofoil sail forces by combining flexural bending measurements and measurements of displacement of a bearing arranged at a connection of the aerofoil sail and its foundation;

using the measured aerofoil sail forces as a feedback in the optimisation of the aerofoil sail operation.

It will be appreciated that an aerodynamic force $F_A$ generated by the aerofoil is counter-balanced by forces from bearings arranged in the support structure. While counter-balancing the aerodynamic force, the aerofoil may undergo flexural bending and a displacement of the bearing point. The flexural bending of the aerofoil causes a strain that can be measured $\Delta L/L_o$, wherein $L_o$ is the specified reference length which length change $\Delta L$ is to be measured after undergoing flexural bending. The measurement system needs to be calibrated to know correlation between load and strain. This correlation value is called a sensitivity. Sensitivity $S_{se}$ is given by equation (7), $$S_{se} = \frac{F_L}{\frac{\Delta L}{L_o}} \tag{7}$$

where $F_L$ is the measured or known force and $\Delta L/L_o$ is the corresponding stain value. Afterwards when sensitivity is known the aerodynamic force is obtained by multiplying the sensitivity by measured strain value. The $F_L$ behaves linearly regarding the strain value. The method further comprises using the measured aerodynamic forces as a feedback in the optimisation of the sail operation. Notably, strain-based measurement of the aerodynamic forces can, beneficially, be employed for cross-verification of results from the pressure-based measurement.

It will be appreciated that implementations of wind propulsion devices other than the Magnus-rotor and the aerofoil sail may also be possible wherein the method described herein above is applicable. Furthermore, various embodiments and variants disclosed above with respect to the aforementioned Magnus-rotor, apply mutatis mutandis to the aerofoil sail, wherever possible, and vice-versa.

The method for controlling a wind propulsion device arranged on a vessel comprises using the estimated pressure distribution as a feedback in closed-loop control method to optimise a control parameters of the wind propulsion device. Notably, subsequent to determining initial approximation for control parameters, the control parameters are implemented on the wind propulsion device. It will be appreciated that due to the change in control parameters, the pressure distribution on the surface of the wind propulsion device varies substantially. Such variation in pressure distribution is estimated to analyse effect of the changed control parameters. Such pressure distribution estimated after implementation of the changed control parameters is used as a feedback in the method described hereinabove to optimise the control parameters of the wind propulsion device. In an example, the initial approximation of control parameters results in a variation in the pressure distribution that reduces the propulsion force provided by the wind propulsion device. Therefore, such variation in pressure distribution is provided as a feedback and another approximation of control parameters is determined for the wind propulsion device.

Hereinafter, there is disclosed a method for controlling a system of wind propulsion devices arranged on a vessel. Notably, the vessel comprises at least two wind propulsion devices thereon. The wind propulsion devices are arranged at different positions on the vessel, with respect to a length of the vessel. In an example, for a length $L_v$ of the vessel, a first wind propulsion device, such as a Magnus-rotor, is arranged at a distance $L_v/4$ from the bow of the vessel along the amidship along central fore and aft line of the vessel, and a second wind propulsion device, such as a second Magnus-rotor, is arranged at a distance $3L_v/4$ along the aforesaid amidship.

It will be appreciated that despite each of the wind propulsion devices operating at optimised control parameters determined using the method described hereinabove, the system of wind propulsion device may not be operating at an optimal efficiency, on account of a turbulent wake generated due to operation of a given wind propulsion device interfering with and negating the operation of another wind propulsion device. Hereinafter, there is provided an improved method of controlling multiple wind propulsion devices in a manner that operation of a given wind propulsion device does not have any negative effect on the operation of another wind propulsion device. Such method enables optimal control of each of the wind propulsion devices in a manner that effect from the system of wind propulsion devices is compounded to increase overall efficiency of the system.

The method for controlling the system of wind propulsion devices arranged on a vessel comprises optimising the control parameters of each wind propulsion device according to the method for controlling a wind propulsion device arranged on a vessel described hereinabove. Firstly, control parameters of each of the wind propulsion devices are optimised individually. As aforementioned, pressure distribution on the surface of each of the wind propulsion devices is estimated to estimate apparent wind angle for the wind propulsion device. Consequently, initial approximation for control parameters is determined, that is optimised using the estimated pressure distribution as a feedback in closed-loop control method.

The method further comprises optimising a total efficiency of the wind propulsion devices using closed-loop control, by taking into account the interaction between each wind propulsion device by measuring the individual differences in performance. Notably, a first wind propulsion device arranged upwind in comparison to a second wind propulsion device may interfere and have a negative effect on the efficiency of second wind propulsion device. Alternatively, the interaction between wind propulsion devices may be caused by the overlap of pressure areas thereof. In particular, if a low-pressure area of the first wind propulsion device overlaps with high-pressure area of the second wind propulsion device, the operation of the second wind propulsion device is negatively affected. Therefore, the control parameters of the first wind propulsion device arranged upwind on the vessel are adjusted to modify the manner of interaction of the inflow of wind around the first propulsion device with pressure distribution of the second wind propulsion device. It will be appreciated that a wind propulsion device disturbs the flow of the wind reaching another wind propulsion device. Such disturbance or change created in the flow of the wind is referred as the inflow of a given wind propulsion device. Often, during its operation, a wind propulsion device further generates a turbulent wake disturbing laminar flow of wind reaching another wind propulsion device. Therefore, the operation of a first wind propulsion device arranged upwind is modified (generally, downgraded) in a manner that the inflow and the turbulent wake of the first wind propulsion device does not affect the operation of the second wind propulsion device. In particular, rotation speed of the first wind propulsion device arranged upwind may be reduced to reduce inflow area and area of the turbulent wake generated thereby.

The performance of each of the wind propulsion devices is measured and the difference therebetween is determined to analyse effect of a given wind propulsion device on another wind propulsion device. Specifically, the control parameters of the first wind propulsion device are altered to analyse effect thereof on efficiency of the second wind propulsion device. Additionally, pressure distribution of each of the wind propulsion devices is analysed and combined with estimated apparent wind angle and angular position information of each of the wind propulsion devices, to determine optimised control parameters of the system of wind propulsion devices, such that the overall efficiency of the system is increased. Notably, the effect of change in control parameters of the first wind propulsion device on the second wind propulsion device is used as a feedback in a closed loop control method to further optimise control parameters of the system of wind propulsion devices.

In an exemplary implementation, the system of wind propulsion devices arranged on a vessel comprises a first Magnus-rotor and a second Magnus-rotor arranged at different positions along the length of the vessel. In a first instance, the control parameters (such as, the rotation speed) of the Magnus-rotors are not optimised based on the method for controlling the wind propulsion device described hereinabove. In such instance, the rotation speed of the Magnus-rotors is determined as equal for both the Magnus-rotors, for example, 180 rotations per minute. Such instance observes a significant overlap between pressure areas of the Magnus-rotors. In a second instance, the control parameters are optimised based on the method for controlling the wind propulsion device described hereinabove. Based on such method, the rotation speed of the second Magnus-rotor is optimised to 140 rotations per minute. Such optimisation results in a significant reduction in fuel consumption. However, since the control parameters are not optimised based on the interaction between each Magnus-rotors, the pressure areas of the Magnus-rotors still observe a significant overlap. In a third instance, the control parameters are optimised based on the interaction between each Magnus-rotors as described hereinabove with respect to the method for controlling a system of wind propulsion devices arranged on a vessel. Therefore, the rotation speed of the first Magnus-rotor is optimised to reduce to 150 rotations per minute and the rotation speed of the second Magnus-rotor is optimised to 130 rotations per minute. Such reduction in rotation speeds of the Magnus-rotors observes no overlap between the pressure areas of the two Magnus-rotors, thereby significantly increasing the efficiency of the Magnus-rotors and reducing fuel consumption.

The present description also relates to a method for controlling a Magnus-rotor arranged on a vessel, comprising providing pressure information from at least a first pressure sensor, which pressure information is pressure distribution along a path of the first pressure sensor, wherein the first pressure sensor is arranged on a surface of the Magnus-rotor; and the first pressure sensor is arranged at a first height H1 with respect to a deck of the vessel;

interpolating and extrapolating the pressure distribution on the surface of the Magnus-rotor based on the pressure information from the at least first pressure sensor;

providing angular position information of the Magnus-rotor from a rotary encoder;

estimating apparent wind angle based on the angular position information and the estimated pressure distribution on the surface of the Magnus-rotor;

calculating wind speed u, by calculating air density ρ based on atmospheric pressure p and temperature T, wherein the atmospheric pressure is approximated by using a dedicated sensor, and using equation (8) where $R_{(specific)}$ is specific gas constant for dry air $$\rho = \frac{p}{R_{(specific)}T}; \tag{8}$$

calculating a maximum dynamic pressure q on the surface of the Magnus-rotor by subtracting the atmospheric pressure from a maximum pressure on the surface of the Magnus-rotor; and calculating the wind speed u using equation (9)

$$u = \sqrt{\frac{2q}{\rho}}; \tag{9}$$

using the estimated apparent wind angle to determine an optimal rotation direction of the Magnus-rotor;

using the calculated wind speed to determine an initial approximation for the optimal rotation speed of the Magnus-rotor; and using a closed-loop control method to operate the Magnus-rotor at a rotor specific optimal rotation per minute, where feedback includes the interpolated and extrapolated pressure distribution.

The present description also relates to another method for controlling a Magnus-rotor arranged on a vessel, comprising measuring Magnus-rotor forces by combining flexural bending measurements and measurements of displacement of a bearing arranged at a connection of the Magnus-rotor and its foundation;

using a closed-loop control method to operate the Magnus-rotor at a rotor specific optimal rotation per minute, where feedback includes the measured Magnus-rotor forces.

Thus, in case Magnus-rotors are used on a vessel, they can be controlled also without using pressure information as explained in the method above, but only by using measured Magnus-rotor forces.

Magnus force $F_m$ generated by the Magnus-rotor is counter-balanced by forces from a upper bearing arranged in the Magnus-rotor support structure and the lower bearing point. While counter-balancing the Magnus force, the Magnus-rotor may undergo flexural bending and a displacement of the bearing point. Notably, the upper bearing constrains the flexural bending of the Magnus-rotor by providing a counter force $F_{mb}$. Herein, the Magnus-rotor undergoes the flexural bending which causes a strain that can be measured $\Delta L/L_o$, wherein $L_o$ is the specified reference length which length change $\Delta L$ is to be measured after undergoing flexural bending. The measurement system needs to be calibrated to know correlation between upper bearing load and strain. This correlation value is called a sensitivity. Sensitivity $S_{se}$ is given by equation (10), $$S_{en} = \frac{F_{mb}}{\frac{\Delta L}{L_o}} \tag{10}$$

where $F_{mb}$ is the measured or known upper bearing force and $\Delta L/L_o$ is the corresponding strain value. Afterwards when sensitivity is known the upper bearing force is obtained by multiplying the sensitivity by measured strain value. The $F_{mb}$ behaves linearly regarding the strain value. Furthermore, the displacement of the lower bearing point is constrained by the force $F_{lb}$, calculated using equation (11)

$$F_{lb}=k_{lb}x \tag{11}$$

where x is the displacement of the lower bearing point and $k_{lb}$ is a calibrated measurement of spring factor for the lower bearing point. $K_{lb}$ is a function of the displacement x. Notably, the total Magnus force shall be a sum of $F_{mb}$ and $F_{lb}$. The method further comprises using the measured Magnus-rotor forces as a feedback in the optimisation of the Magnus-rotor operation. Notably, strain-based measurement of the Magnus-rotor forces can, beneficially, be employed for cross-verification of results from the pressure-based measurement. Furthermore, the magnitude of flexural bending and displacement observed in Magnus-rotors is significantly low. Therefore, sophisticated measurement arrangements such as an arrangement comprising electrical connection of two strain gauge resistive bridges installed at opposite ends of the Magnus-rotor, thereby creating an amplification of the strain signal, are employed. Beneficially, diametrically opposed measurements from such sensors negate effects of thermal expansion in the Magnus-rotor.

The present disclosure uses numbering notations (1), (2), (3), (4), (5), (6), (7), (8), (9), (10) and (11)) for equations. The equations (1), (5) and (8) are used for calculating air density value for each respective embodiment. The equations (2), (6) and (9) are used to calculate the wind speed for each of the respective embodiment. The equations (3) and (10) are used to calculate sensitivity value for embodiments related to a Magnus rotor and equation (7) a sensitivity value for an aerofoil. The equations (4) and (11) are used to calculate force $F_{lb}$ for respective embodiments.

The present disclosure further provides a vessel comprising at least two wind propulsion devices, each wind propulsion device comprising at least a first pressure sensor, wherein the first pressure sensor is arranged on a surface of the wind propulsion device at a first height H1 with respect to a deck of the vessel, and the vessel is further equipped with means for carrying out the methods described hereinabove. The embodiments and variants explained above apply mutatis mutandis to the vessel.

The present disclosure further provides a software product recorded on non-transient machine-readable data storage media, wherein the software product is executable upon computing hardware for implementing a method for controlling a wind propulsion device arranged on a vessel as described hereinabove.

DETAILED DESCRIPTION OF THE DRAWINGS

Referring to FIG. 1, there is shown an illustration of steps of a method 100 for controlling a wind propulsion device arranged on a vessel, in accordance with an embodiment of the present disclosure. At a step 102, pressure information is provided from at least a first pressure sensor arranged on a surface of the wind propulsion device at a first height H1 with respect to a deck of the vessel. At a step 104. Pressure distribution on the surface of the wind propulsion device is estimated based on the pressure information from the at least first pressure sensor. At a step 106, angular position information of wind propulsion device is provided. At a step 108, apparent wind angle is estimated based on the angular position information of wind propulsion device and the estimated pressure distribution on the surface of the wind propulsion device. At a step 110, initial approximation for control parameters is determined using the estimated apparent wind angle. At a step 112, the estimated pressure distribution is used as a feedback in closed-loop control method to optimise the control parameters of the wind propulsion device.

The steps 102 and 116 are only illustrative and other alternatives can also be provided where one or more steps are added, one or more steps are removed, or one or more steps are provided in a different sequence without departing from the scope of the claims herein.

Figure 2:
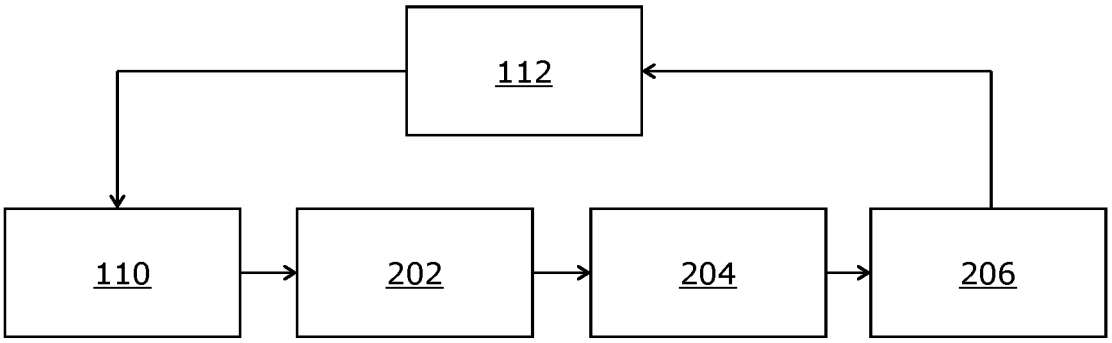
FIG. 2 is a block diagram of closed loop control method used for optimisation of control parameters, in accordance with an illustration of the present disclosure.

Referring to FIG. 2, there is shown a block diagram of closed loop control method used for optimisation of control parameters, in accordance with an illustration of the present disclosure. Herein as described in FIG. 1, at step 110, initial approximation for control parameters is determined using the estimated apparent wind angle, wherein apparent wind angle is estimated based on the angular position information of wind propulsion device and the estimated pressure distribution on the surface of the wind propulsion device. At a step 202, the initial approximation of the control parameters is implemented on the wind propulsion device. Subsequently, the step 204, after implementation of the control parameters, the pressure information is provided from at least a first pressure sensor arranged on a surface of the wind propulsion device at a first height H1 with respect to a deck of the vessel. At step 206, the pressure distribution on the surface of the wind propulsion device is estimated based on the pressure information from the at least first pressure sensor. Thereafter at step 112, pressure distribution estimated on the surface of the wind propulsion device is used as a feedback in closed-loop control method to determine another approximation for control parameters in order to optimise the control parameters of the wind propulsion device.

Figure 3:
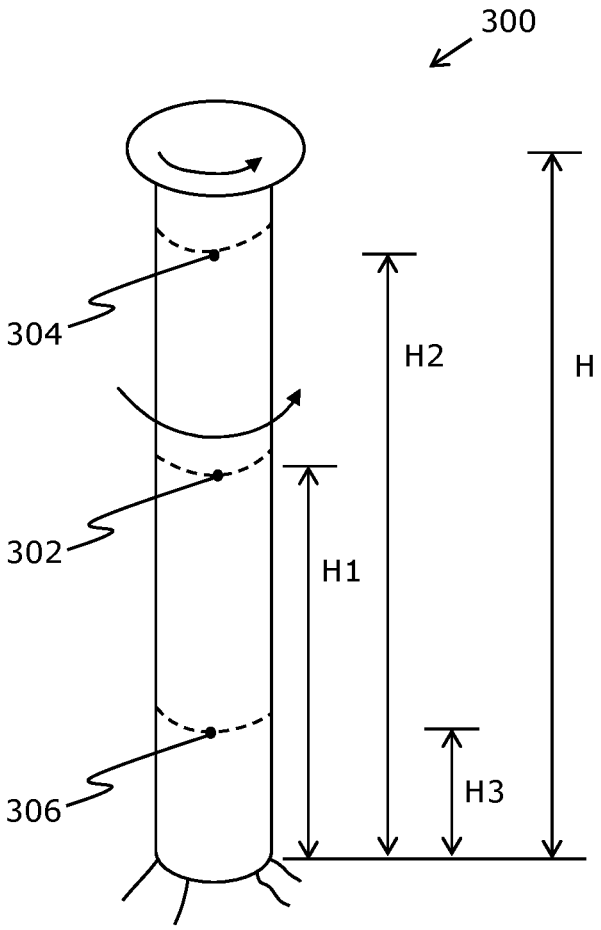
FIG. 3 is an illustration of a Magnus-rotor as a wind propulsion device, in accordance with an embodiment of the present disclosure.

Referring to FIG. 3, illustrated is a Magnus-rotor 300 as a wind propulsion device, in accordance with an embodiment of the present disclosure. As shown, a first pressure sensor 302 is arranged on a surface of the Magnus-rotor 300 at a first height H1 with respect to a deck of the vessel. A second pressure sensor 304 is arranged at a second height H2 with respect to the deck of the vessel. Notably, a difference between the first height H1 and the second height H2 is at least 20% of a total height H of the Magnus-rotor Similarly, a third pressure sensor 306 is arranged at a third height H3 with respect to the deck of the vessel and a difference between the first height H1, the second height H2 and the third height H3 is each at least 10% of the total height H of the Magnus-rotor. It will be appreciated that as the Magnus-rotor 300 rotates, the pressure sensors 302, 304 and 306 rotating with the Magnus-rotor 300 measure pressure information relating to different areas on the surface of the Magnus-rotor 300.

Figure 4:
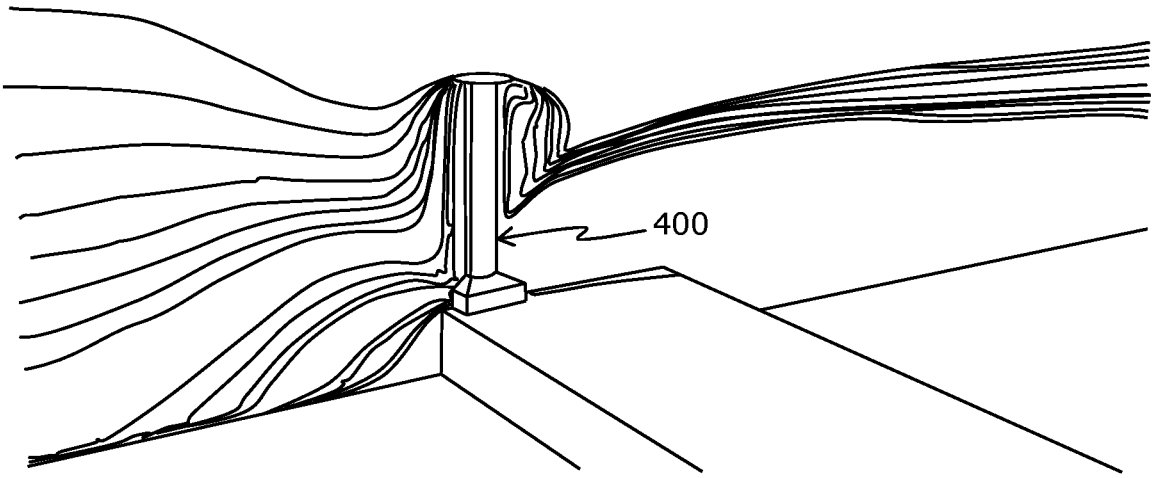
FIG. 4 is schematic illustration of an inflow of wind at a Magnus-rotor.

Referring to FIG. 4, illustrated is an inflow of wind at a Magnus-rotor 400. Notably, as shown, the inflow of the wind is significantly altered due to the Magnus-rotor 400. The lines in the figure represent velocity iso-contours.

Figure 5:
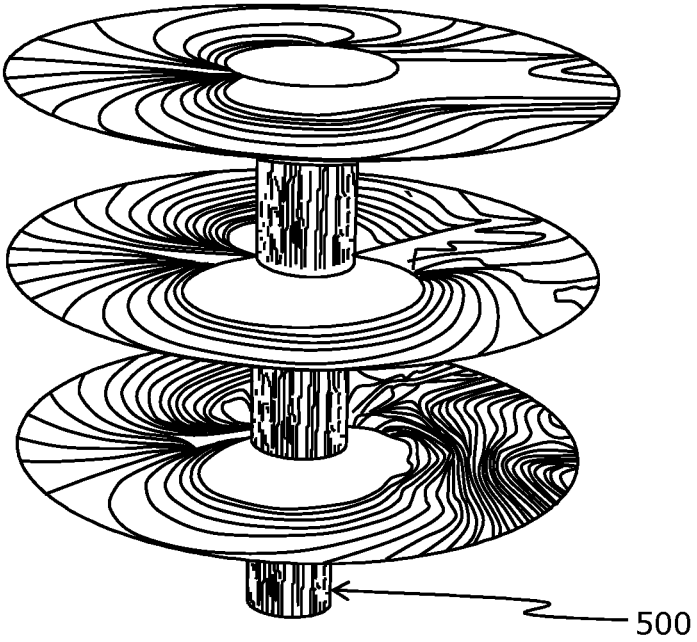
FIG. 5 is a schematic illustration of pressure distribution at different heights of a Magnus-rotor due to non-uniform inflow.

Referring to FIG. 5, there is shown a schematic illustration of pressure distribution at different heights of a Magnus-rotor 500 due to non-uniform inflow. The lines in the figure represent pressure iso-contours.

Figure 6:
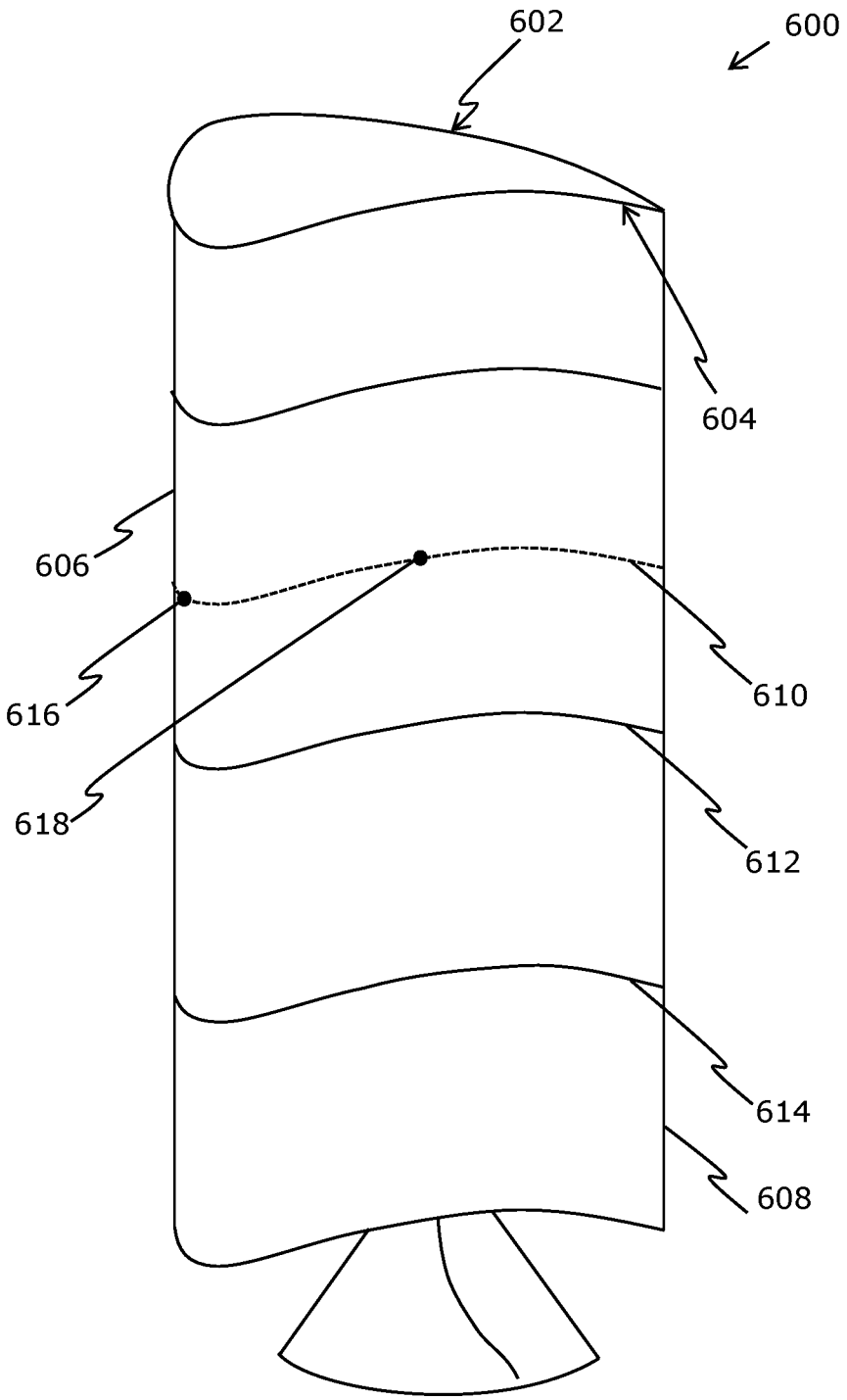
FIG. 6 is an illustration of an aerofoil sail as a wind propulsion device, in accordance with an embodiment of the present disclosure.

Referring to FIG. 6, illustrated is an aerofoil sail 600 as a wind propulsion device, in accordance with an embodiment of the present disclosure. Notably, the aerofoil sail 600 has a camber structure having a convex side 602 and a concave side 604, wherein due to the aerofoil structure of the sail 600 and the movement of wind along the aerofoil, a lower pressure on a convex side 602 of the aerofoil sail 600 is observed in comparison to the pressure on a concave side 604 of the aerofoil sail 600. As shown, the aerofoil sail 600 has a leading edge 606 that directly penetrates the flow of the wind, and a trailing edge 608. Notably, the aerofoil sail 600 comprises different chords, such as the chords 610, 612, 614 at different heights. Furthermore, a first pressure sensor 616 is arranged on a surface of the aerofoil sail 600 at a first height H1 with respect to a deck of the vessel. Additionally, a second pressure sensor 618 arranged on the surface of the aerofoil sail 600 along the same chord 610 as the first pressure sensor 616 at the height H1 with respect to the deck of the vessel.

Figure 7:
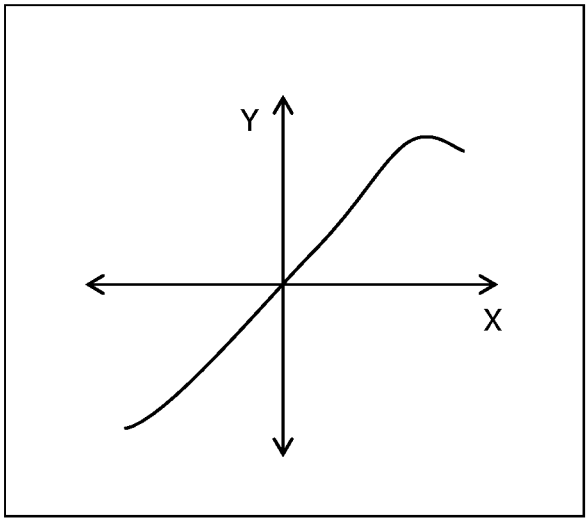
FIG. 7 is a graph representing a relationship between rotation speed and net benefit when wind propulsion device is implemented as a Magnus-rotor, in accordance with an embodiment of the present disclosure.

Referring to FIG. 7, there is shown a graph representing a relationship between rotation speed and net benefit when wind propulsion device is implemented as a Magnus-rotor, in accordance with an embodiment of the present disclosure. Herein, the X-axis of the graph represents rotation speed and Y-axis represents net benefit from the Magnus-rotor. Notably, the net benefit refers to energy savings or reduction in fuel consumption due to propulsion force provided by the Magnus-rotor. As the graph illustrates, the net benefit increases with an increase in rotation speed of the Magnus-rotor until an inflection point after which energy consumed to generate rotation in the Magnus-rotor outweighs the benefit received from the propulsion force generated thereby.

Figure 8:
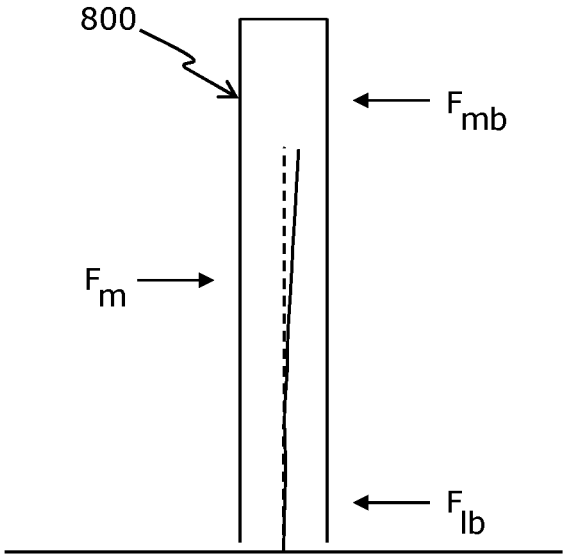
FIG. 8 is an illustration of forces acting on a Magnus-rotor.

Referring to FIG. 8, illustrated are forces acting on a Magnus-rotor 800. Notably, a Magnus force $F_m$ is generated due to the rotation of the Magnus-rotor 800. The force $F_m$ is counter-balanced by forces from a upper bearing arranged in the Magnus-rotor 800 and a lower bearing point arranged at the connection of the Magnus-rotor 800 and the foundation of the Magnus-rotor 800. While counter-balancing the Magnus force, the Magnus-rotor 800 may undergo flexural bending and a displacement of the bearing. Notably, the upper bearing constrains the flexural bending of the Magnus-rotor 800 by providing a counter force $F_{mb}$. Furthermore, the displacement of the bearing arranged at the lower bearing point i.e at the connection of the Magnus-rotor 800 and its foundation is constrained by the force $F_{lb}$.

Figure 9:
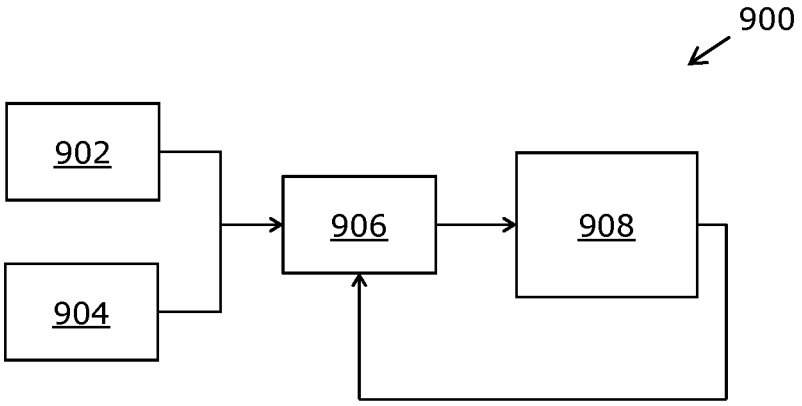
FIG. 9 is an illustration of steps of a method of controlling a system of wind propulsion devices, in accordance with an embodiment of the present disclosure.

Referring to FIG. 9, there is shown an illustration of steps of a method 900 of controlling a system of wind propulsion devices, in accordance with an embodiment of the present disclosure. Herein, the method 900 is described with respect to a first wind propulsion device and a second wind propulsion device, wherein the first propulsion device is arranged upwind on the vessel in comparison to the second propulsion device. At step 902, control parameters with respect to the first propulsion device are optimised using the method for controlling a wind propulsion device arranged on a vessel (such as the method 100 described in FIG. 1). At step 904, control parameters with respect to the second propulsion device are optimised using the aforementioned method 100. At step 906, interaction between pressure distributions of the first propulsion device and the second propulsion device is compared to determine an effect of the first propulsion device on the pressure distribution of the second propulsion device. At step 908, a total efficiency of the system of wind propulsion device is determined and the result is provided as a feedback at step 906 for optimisation of control parameters of the first propulsion device and the second propulsion device.

Figure 10:
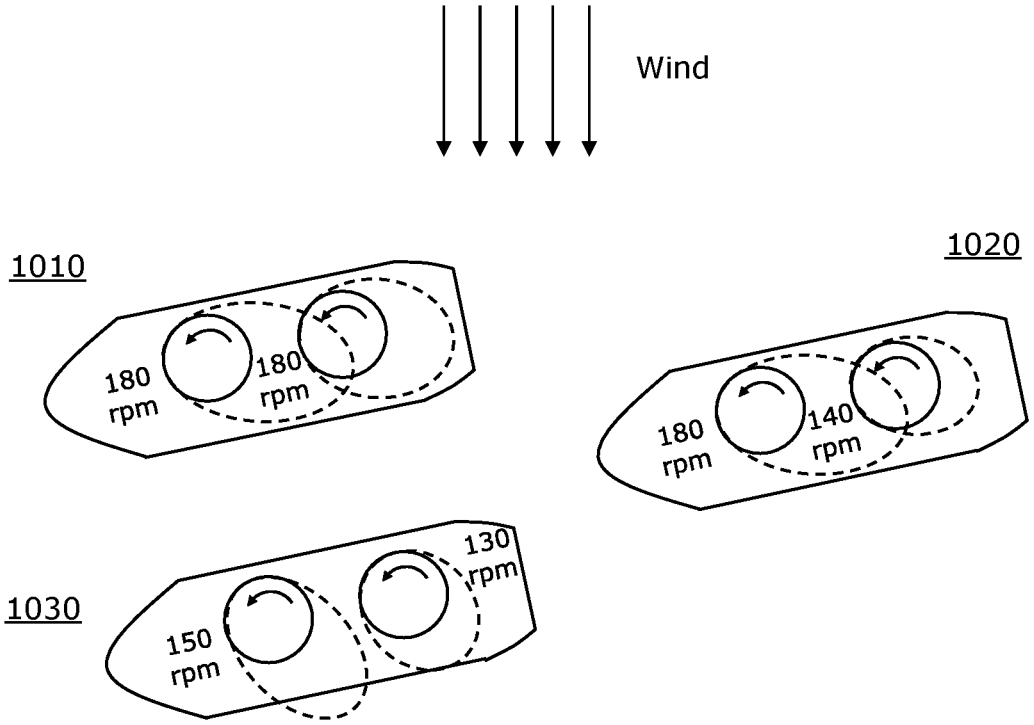
FIG. 10 is a schematic illustration of a vessel in different instances of optimisation of control parameters, in accordance with an exemplary implementation of the present disclosure.

Referring to FIG. 10, there is shown a schematic illustration of a vessel in different instances of optimisation of control parameters, in accordance with an exemplary implementation of the present disclosure. The vessel comprises a first Magnus-rotor and a second Magnus-rotor arranged at different positions along the length of the vessel. In a first instance 1010, the control parameters (such as, the rotation speed) of the Magnus-rotors are not optimised based on the method 100 for controlling the wind propulsion device described hereinabove. In such instance 1010, the rotation speed of the Magnus-rotors is determined as equal for both the Magnus-rotors, for example, 180 rotations per minute. Such instance 1010 observes a significant overlap between pressure areas of the Magnus-rotors. In a second instance 1020, the control parameters are optimised based on the method 100 for controlling the wind propulsion device described hereinabove. Based on such method 100, the rotation speed of the second Magnus-rotor is optimised to 130 rotations per minute. Such optimisation results in a significant reduction in fuel consumptions. However, since the control parameters are not optimised based on the interaction between each Magnus-rotors, the pressure areas of the Magnus-rotors still observe a significant overlap. In a third instance 1030, the control parameters are optimised based on the interaction between each Magnus-rotors as described hereinabove with respect to the method 900 for controlling a system of wind propulsion devices arranged on a vessel. Therefore, the rotation speed of the first Magnus-rotor is optimised to reduce to 150 rotations per minute and the rotation speed of the second Magnus-rotor is optimised to 140 rotations per minute. Such reduction in rotation speeds of the Magnus-rotors observes no overlap between the pressure areas of the two Magnus-rotors, thereby significantly increasing the efficiency of the Magnus-rotors and reducing fuel consumption.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A method for controlling a magnus rotor arranged on a vessel, comprising:

providing pressure information related to different areas of a cross section from a first pressure sensor arranged on a surface of the magnus rotor at a first height H1 with respect to a deck of the vessel;

estimating pressure distribution on the surface of the magnus rotor based on the pressure information from the first pressure sensor; and using the estimated pressure distribution as a feedback in closed-loop control method to optimize control parameters of the magnus rotor.

2. The method according to claim 1, wherein the method further comprises:

providing angular position information of the magnus rotor;

estimating apparent wind angle based on angular position information of the magnus rotor and the estimated pressure distribution on the surface of the magnus rotor; and using the estimated apparent wind angle for determining initial approximation for control parameters.

3. The method according to claim 2, wherein the angular position information is provided by an angular position measurement device;

the control parameters comprise optimal rotation speed of the Magnus-rotor;

the method further comprising:

calculating wind speed u, by calculating air density ρ based on atmospheric pressure p and temperature T, wherein the atmospheric pressure is either approximated by a pressure at a back side of the rotor or using a dedicated sensor, and using equation (1) where $R_{(specific)}$ is specific gas constant for dry air $$\rho = \frac{p}{R_{(specific)}T}; \quad (1)$$

calculating a maximum dynamic pressure q on the surface of the Magnus-rotor by subtracting the atmospheric pressure from a maximum pressure on the surface of the Magnus-rotor; and calculating the wind speed u using equation (2)

$$u = \sqrt{\frac{2q}{\rho}}; \quad (2)$$

using the estimated apparent wind angle to determine an optimal rotation direction of the Magnus-rotor; and using the calculated wind speed, in addition to the estimated apparent wind angle, to determine the initial approximation for control parameters.

4. The method according to claim 3, further comprising providing pressure information from at least a second pressure sensor, wherein the second pressure sensor is arranged at a second height H2 with respect to the deck of the vessel;

a difference between the first height H1 and the second height H2 is at least 20% of a total height H of the Magnus-rotor; and estimating pressure distribution is carried out by interpolating and extrapolating the pressure distribution on the surface of the Magnus-rotor based on the pressure information from the at least first pressure sensor and second pressure sensor.

5. The method according to claim 4, further comprising arranging at least a third pressure sensor on the surface of the Magnus-rotor, wherein the third pressure sensor is arranged at a third height H3 with respect to the deck of the vessel and a difference between the first height H1, the second height H2 and the third height H3 is each at least 10% of the total height H of the Magnus-rotor.

6. The method according to claim 3, further comprising arranging a number of further pressure sensors on the surface of the Magnus-rotor, wherein each further pressure sensor is arranged at a given height with respect to the deck of the vessel and the difference between each height of the pressure sensors is at least 5% of the total height H of the Magnus-rotor, and wherein the number is at least four.

7. The method according to claim 4, wherein the pressure sensors are arranged along a line that is substantially parallel to a rotation axis of the Magnus-rotor.

8. The method according to claim 4, wherein the pressure sensors are arranged along a spiral line.

9. The method according to claim 3, further comprising:

measuring Magnus-rotor forces by combining flexural bending measurements and measurements of displacement of a bearing arranged at a connection of the Magnus-rotor and its foundation;

using the measured Magnus-rotor forces as a feedback in the optimisation of the Magnus-rotor operation.

10. A software product recorded on non-transient machine-readable data storage media, wherein the software product is executable upon computing hardware for implementing a method of claim 1.

11. A method for controlling a system of magnus rotors arranged on a vessel, comprising:

optimizing control parameters of each magnus rotor in the system by:

providing pressure information related to different areas of a cross section from a first pressure sensor arranged on a surface of each magnus rotor at a first height H1 with respect to a deck of the vessel;

estimating a pressure distribution on the surface of each magnus rotor based on the pressure information from the first pressure sensor; and using the estimated pressure distribution as a feedback in a closed-loop control method to optimize the control parameters of each magnus rotor; and optimizing a total efficiency of each magnus rotor using the closed-loop control method by taking into account an interaction between each magnus rotor by measuring individual differences in performance; and wherein each magnus rotor is arranged at a different position on the vessel with respect to a length of the vessel.

12. A vessel comprising at least two magnus rotors, the at least two magnus rotors each comprising a first pressure sensor, wherein the first pressure sensor is arranged on a surface of each of the at least two magnus rotors at a first height H1 with respect to a deck of the vessel, and the vessel is configured to each of the at least two magnus rotors by:

providing pressure information related to different areas of a cross section from a first pressure sensor arranged on a surface of each of the at least two magnus rotors at a first height H1 with respect to a deck of the vessel;

estimating a pressure distribution on the surface of each of the at least two magnus rotors based on the pressure information from the first pressure sensor; and using the estimated pressure distribution as a feedback in a closed-loop control method to optimize control parameters of each of the at least two magnus rotors.

* * * * *